US007000524B2

(12) United States Patent
Beal

(10) Patent No.: US 7,000,524 B2
(45) Date of Patent: Feb. 21, 2006

(54) METHOD FOR MANUFACTURE OF A MULTI-PART PROJECTILE FOR GUN AMMUNITION AND PRODUCT PRODUCED THEREBY

(75) Inventor: Harold F. Beal, Rockford, TN (US)

(73) Assignee: Doris Nebel Beal Inter Vivos Patent Trust, Pawleys Island, SC (US)

( * ) Notice: Subject to any disclaimer, the term of this patent is extended or adjusted under 35 U.S.C. 154(b) by 0 days.

(21) Appl. No.: 10/672,513

(22) Filed: Sep. 26, 2003

(65) Prior Publication Data

US 2005/0034592 A1 Feb. 17, 2005

Related U.S. Application Data

(63) Continuation of application No. 10/001,390, filed on Oct. 23, 2001, now abandoned, which is a division of application No. 09/264,072, filed on Mar. 8, 1999, now Pat. No. 6,317,946, which is a continuation-in-part of application No. 09/198,823, filed on Nov. 24, 1998, now Pat. No. 6,457,417, and a continuation-in-part of application No. 08/888,270, filed on Jul. 3, 1997, now abandoned, and a continuation-in-part of application No. 08/887,774, filed on Jul. 3, 1997, now abandoned.

(51) Int. Cl.
*F42B 12/72* (2006.01)

(52) U.S. Cl. ..... 86/19.6; 102/502; 102/516

(58) Field of Classification Search ..... 86/18, 86/19.5, 19.6; 102/516, 518, 502, 439, 444
See application file for complete search history.

(56) References Cited

U.S. PATENT DOCUMENTS

| | | | | | |
|---|---|---|---|---|---|
| 1,992,216 | A | * | 2/1935 | Kirst et al. | 102/313 |
| 3,318,244 | A | * | 5/1967 | Rostocil | 102/436 |
| 3,517,619 | A | * | 6/1970 | Niemann | 102/529 |
| 3,977,324 | A | * | 8/1976 | Stevenson et al. | 102/442 |
| 5,913,256 | A | * | 6/1999 | Lowden et al. | 75/248 |

FOREIGN PATENT DOCUMENTS

GB 2 170 301 A * 7/1986

* cited by examiner

*Primary Examiner*—Stephen M. Johnson
(74) *Attorney, Agent, or Firm*—Pitts & Brittain, P.C.

(57) ABSTRACT

A method for the manufacture of a projectile for small-bore weapons ammunition comprising the steps of producing a compact from a mixture of a heavy metal powder and a light metal powder at room temperature, and without further treatment of the compact, introducing the compact into a metal jacket, including pressing the compact into the jacket with a pressure sufficient to ensure substantially complete filling of a selected portion of the jacket by the compact. The compacts fill less that the entire volume of the jacket, leaving a portion of the jacket void of the compact. Prior to the pressing of the compact into the jacket, a disc having an outer diameter substantially equal to the internal diameter of said jacket adjacent the open end thereof is introduced into the jacket. Thereafter, that portion of the jacket adjacent its open end is infolded toward the longitudinal centerline of the jacket to at least substantially close the open end of the jacket.

A unique projectile and a round of ammunition formed with the projectile are disclosed.

3 Claims, 4 Drawing Sheets

METHOD FOR MANUFACTURE OF A MULTI-PART PROJECTILE FOR GUN AMMUNITION AND PRODUCT PRODUCED THEREBY

RELATED APPLICATIONS

This application is a continuation application of copending application, Ser. No. 10/001,390, now abandoned, which is a division of application Ser. No. 09/264,072, filed Mar. 8, 1999, (now U.S. Pat. No. 6,317,946, issued Nov. 20, 2001) which is a continuation-in-part of application Ser. No. 09/198,823, filed on Nov. 24, 1998, (now U.S. Pat. No. 6,457,417, issued Oct. 1, 2002) and a continuation-in-part of application Ser. No. 08/887,774, filed on Jul. 3, 1997, now abandoned, and a continuation-in-part of application Ser. No. 08/888,270, filed on Jul. 3, 1997, now abandoned.

FIELD OF INVENTION

This invention relates to gun ammunition and particularly to methods for the manufacture of projectiles for gun ammunition and to the projectiles produced thereby. In particular, the method and the projectiles of the present invention relate to ammunition for small-bore weapons of .50 caliber or smaller bore and to the use of mixtures of metal powders in the manufacture of projectiles.

BACKGROUND OF INVENTION

The use of a mixture of a heavy metal powder, ie., a metal having a density greater than the density of lead and a light metal powder, ie., a metal having a density less than the density of lead, to form a unitary projectile has been suggested. These unitary projectiles, however, suffer several shortcomings. For example these projectiles are almost universally formed by initial compaction in a die cavity. As a consequence, these unitary projectiles are limited with respect to the total weight of a projectile that can be formed in a given cavity. For example, cold-pressed heavy metal powders can be reduced in volume, e.g. densified, by only a limited amount in a die pressing operation. This limitation is in part attributable to the inherent incompressibility of heavy (dense) metal powders. Further, such powders tend to bridge themselves within the die and effectively halt movement of the punch being used to compress the powder within the die. The use of greater die pressing pressures only serves to more firmly bind the green compact within the die, resulting in its destruction when one attempts to extract the pressed compact from the die cavity. These unitary powder-based projectiles, therefore, are limited to a range of overall density which is solely a function of the percentage of the heavy metal powder employed in the powder mixture.

These physical limitations relating to the relative incompressibility of a heavy metal powder, or a mixture of metal powders in which the heavy metal powder is the dominant powder, has led to the use of various techniques for densifying powder compacts, principally by heat treatments such as sintering or alloying of the powders of the mixture. These techniques, among other things, are cost prohibitive when manufacturing large numbers of projectiles. Moreover, these techniques convert the powders of the projectile to solid bodies which destroys certain beneficial features of non-sintered powders, such as their frangibility which is an important feature in projectiles intended for law enforcement and military activities.

U.S. Pat. No. 5,760,331 discloses a projectile formed from a mixture of heavy and light metal powders. This patent teaches a range of percentages of heavy metal powder to light metal powder, as well as the use of a variety of metal powders, but does not teach adjustability of the overall weight of a projectile for each of the percentages. The projectiles of this patent are unitary in that they comprise a single pressed compact of the mixture of metal powders. The density of these unitary projectiles along their length is not noted to be selectable.

U.S. Pat. No. 5,279,787 exemplifies the prior art efforts to densify a die-formed green compact by sintering and/or alloying techniques.

In U.S. Pat. No. 2,393,648 there is disclosed a stratified projectile which is formed by layering in a die cavity a plurality of layers, each of which comprises a mixture of metal powders which, when heated, form an alloy of a specific toughness or hardness. These layers are progressively tougher or harder from the trailing end of the projectile to the tip of the leading end thereof. By this means, the projectile is said to more readily penetrate armor plate. The projectiles of this patent are not subject to alteration of their overall weight without destroying their designed function.

U.S. Pat. No. 4,716,835 discloses a maneuver ammunition cartridge having a disintegrating projectile. The projectile of this cartridge comprises a thin weak outer covering which ruptures upon the cartridge leaving the barrel of the weapon, due to the spin imparted to the projectile by the rifling of the barrel. The projectile of this patent includes a hollow tapered nose section which is filled with a foam material that serves to resist indentation of the covering during cycling of the cartridge through an automatic or semi-automatic weapon. This nose section of the projectile is separated from a plurality of "pressed" metal powder bodies that are stacked within the cylindrical body section of the projectile, in axial alignment with one another and with the longitudinal axis of the projectile. The separation between the foam-filled nose section and the powder bodies-containing cylindrical section of the projectile is defined by a "stiffening insert made of plastic" and comprises two cup sections each open at one end, and presents a circular disc member oriented transverse of the longitudinal axis of the projectile. Once the outer covering is ruptured by reason of the spin of the projectile after it leaves the gun barrel, all of the components of the projectile dissipate over a short distance so as to not present a danger to troops. This projectile, is useless as a projectile which is intended to strike a target and impart substantial destructive force to the target.

It is an object of the present invention to provide a method for the manufacture of a gun ammunition projectile and by which the overall weight of the projectile and other desirable physical characteristics of the projectile and/or its terminal ballistics are attainable.

It is another object of the present invention to provide a projectile for gun ammunition wherein various physical characteristics, and accompanying performance characteristics, of the projectile are provided.

SUMMARY OF INVENTION

Figure 1:
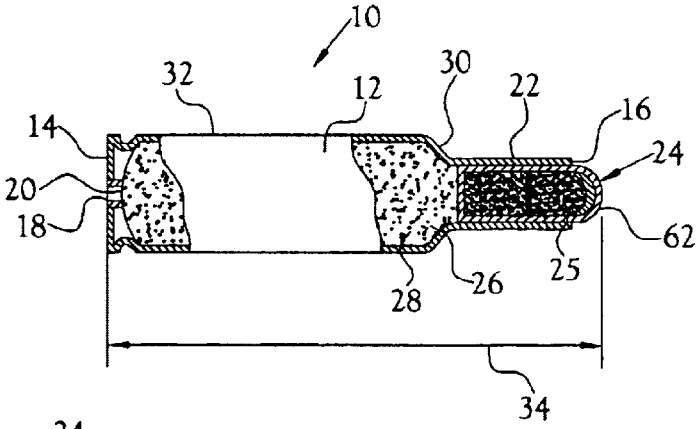
FIG. 1 is a representation of a rifle cartridge, partly sectioned, depicting various of the features of the present invention.

The present invention provides a method for the manufacture of a projectile for small-bore weapons ammunition comprising admixing a quantity of a heavy metal powder, (a "heavy" metal being defined as a metal having a density greater than the density of lead), with a quantity of a light metal powder, (ie., a "light" metal being defined as a metal having a density not greater than the density of lead) introducing a first quantity of the mixture into a die cavity, and pressing the first quantity of the mixture in the die cavity at approximately room temperature into a first non-sintered self-supporting compact having a body portion of substantially straight cylindrical geometry and having first and second opposite ends and a longitudinal centerline. Without further treatment of the first compact, the first compact, introducing the first compact into a jacket having a generally cylindrical void internal volume, an open end and a closed end and a longitudinal centerline. At approximately room temperature, the first compact is pressed into the jacket to position the first compact with its first end thereof disposed adjacent the closed end of the jacket. A second quantity of the mixture into a die cavity, is introduced into a die cavity, pressed into the die cavity at approximately room temperature into a second non-sintered self-supporting compact having a body portion of substantially straight cylindrical geometry and having first and second opposite ends and a longitudinal centerline. Without further treatment of the second compact, it is introduced into the jacket with its first end disposed in abutting relationship with the second end of the first compact and with the centerlines of the first and second compacts in alignment with one another and with the centerline of the jacket. At approximately room temperature, the second compact is pressed against the first compact with a pressure sufficient to cause the first and second compacts to substantially fill the jacket between the closed end of the jacket and the second end of the second compact, leaving a portion of the open end of the jacket void of the compacts. A separator disc is introduced within the jacket and in abutting relationship to the second end of the second compact, the disc having an outer diameter substantially equal to the internal diameter of the jacket adjacent the second end of the second compact. Thereafter, the open end of the jacket is infolded against at least the second end of the second compact and the disc to substantially close the open end of the jacket, the infolding of the open end of the jacket deforming the second end of the second compact and the disc to define a leading end of the projectile.

In accordance with one aspect of the present method, subject to the physical limitations on the jacket of the projectile, there is little limitation on the number of pressed compacts which may be included in the projectile. In similar manner, there may be discs interposed between the abutting faces of any or all of the compacts of the projectile. In one form of the projectile of the present invention, multiple discs are employed to establish a plurality of dispersion patterns of the powder of the projectile upon striking a target. In another form of the projectile, the disc disposed adjacent the leading end of the projectile serves to control the degree of penetration of the projectile into a target before disintegration thereof and/or to produce a more uniform dispersion pattern of the powder of the disintegrating projectile. In other forms, the center of gravity of the overall projectile may be adjusted along the longitudinal centerline of the projectile by selecting a relatively heavy compact for placement at a selected location along the projectile centerline, or through the use of compacts of different crush strengths, more or less frangibility of the projectile may be provided. Further, through the use of multiple compacts in a single projectile, the present inventor provides for the production of a projectile which is suitable for use in gun ammunition for semi-automatic or automatic weapons having a closed gas system for operating the bolt of the weapon, and wherein the projectile travels at a subsonic velocity and the gas pressure associated with the propulsion of the projectile is effective to consistently operate the bolt of the weapon.

By reason of the ability afforded by the present method of individually pressing each of the compacts into the jacket, there is provided more certain and complete filling of the jacket by the compacts, ie., undesirable voids are minimized or essentially eliminated. Individual pressing of the compacts into the jacket also essentially eliminates binding of the powder-based compact with the internal wall of the jacket and consequential failure of the compacts to appropriately fill the jacket volume.

These factors contribute to achieving maximum acuracy of flight of the projectiles of the present invention to a target, and in certain instances to achieving maximum overall density of the projectile.

The present invention further provides a projectile for gun ammunition comprising a metal generally cup-shaped jacket having a closed end, an open end, a void internal volume of generally cylindrical geometry and a longitudinal centerline, a first compact having first and second opposite ends, a substantially cylindrical body portion disposed between the first and second ends and a longitudinal centerline, the first compact being disposed within the jacket with the first end thereof abutting the closed end of the jacket and substantially filling the jacket in the region adjacent the closed end of the jacket, a second compact having first and second opposite ends, a substantially cylindrical body portion disposed between the first and second ends and a longitudinal centerline, the second compact being disposed within the jacket with the first end thereof disposed in abutting relationship to the second end of the first compact, the centerlines of the first and second compacts being aligned with one another and with the centerline of the jacket, a disc disposed within the jacket in overlying and abutting relationship to the second end of the second compact, the first and second compacts and the disc incompletely filling the internal volume of the jacket whereby a portion of the jacket projects beyond the disc, the portion of the jacket which projects beyond the disc being infolded toward the centerline of the jacket to less than completely close the open end of the jacket and wherein at least a portion of the second end of the second compact and the disc are deformed to conform to at least a substantial portion of the internal volume of the jacket as deformed by the infolded portion of the jacket.

In accordance with one aspect of the present invention, the overall weight of the projectile may be varied over a large range of weights through selection of the degree of compaction afforded each of the compacts during their cold-pressing formation, as well as through selection of the percentages of heavy metal powder relative to the light metal powder of the mixture of powders. Choice of the overall weight of a projectile offers the ability to maximize the weight of a given caliber projectile for purposes of developing subsonic ammunition, for example, or to enhance the accuracy of the flight of the projectile to a target. Further, as desired, the compacts which make up a given projectile may be formed of different compositions of metal powders, percentages of heavy and light metal powders, and/or be cold-pressed to different degrees during their die formation, thereby providing a large variety of physical properties of a given projectile. Such physical properties may affect the spin stability of the projectile by providing the ability to adjust the center of gravity of the projectile along the length of the projectile. The extensive range of attainable physical characteristics of the projectile of the present invention further provides for the development of subsonic ammunition for weapons operated in a semi-automatic or automatic mode and having a closed gas system for operation of the bolt. Still further, the present invention provides the ability to ensure the uniformity of the density of the projectile in a direction radially of the centerline of the projectile and within a plane normal to such centerline.

The individual compacts that comprise the projectile of the present invention may be compressed at pressures between about 10,000 and 330,000 psi during cold pressing thereof, and be made self supporting with a crush strength of less than 200 as required for a projectile designed for specific terminal ballistics, etc. In one embodiment of the present projectile, each compact of the projectile may be provided with greater density at each of its opposite ends than in the body region between its opposite ends. This feature can contribute to maximization of the overall density of the projectile for a given length of projectile. Projectiles of an overall weight of between about 40 and about 253 grains for use in 5.56 mm or .308 caliber weapons are readily produced employing the present method. Heavier projectiles may be produced for larger caliber ammunition.

In accordance with another aspect of the present invention, there is provided a gun ammunition cartridge which includes a projectile in accordance with the present invention.

DETAILED DESCRIPTION OF INVENTION

A round of ammunition embodying various of the features of the present invention including a multi-part core 25 in a jacketed projectile having an axially uniform density is illustrated generally at 10 in FIG. 1. In the present invention, the core 25 of the projectile 24 comprises a plurality of discrete pressed compacts, each of which is formed from a powder mixture that includes a heavy metal powder. A "heavy" metal powder is defined for present purposes as a powder of a metal having a density greater than the density of lead, e.g. more than 11.34 g/cc. In a preferred embodiment the powder mixture includes at least one further metal powder of a metal having a density not greater than the density of lead, ie., a light metal powder.

Each of the pressed compacts of the projectile 24 of the present invention is selected in combination with the other elements of the projectile to provide a projectile having a selectable variety of firing characteristics and/or terminal ballistics, or a combination thereof. For example, the method of the present invention may be employed to produce a heavy, small projectile which can be propelled at supersonic velocity in excess of about 3000 feet per second (fps), or to produce a projectile which can be fired consistently subsonically from a weapon which includes a closed gas operated bolt system and which is fired in the semi-automatic or automatic mode. Further the method is useful in the production of projectiles which exhibit different degrees of frangibility, target penetration, accuracy of flight to a target, or a combination of these and other characteristics. Moreover, projectiles produced employing the present method provide these and other advantages consistently from round to round of the ammunition.

Figure 12:
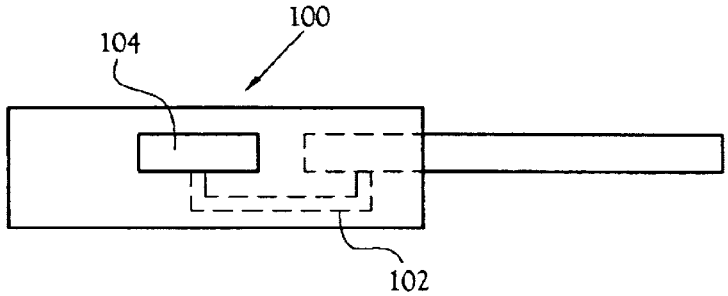
FIG. 12 is a schematic representation of a weapon, including a bolt operated by a closed gas system.

FIG. 1 illustrates one embodiment of a round of ammunition 10 of the present invention which includes a generally tubular case 12 having a closed end 14 and an open end 16. Within the closed end 14 there is provided a flame port 20 and a primer 18 disposedwith the flame port. The case open end 16 includes a necked-down; ie., reduced diameter, portion 22 which is separated from the full diameter case body 32 by a shoulder 30. The necked-down portion 22 is internally sized to receive therein a projectile 24 having a multi-part core 25 in accordance with the present invention. The case further defines a cavity 26 between the closed end 14 and the projectile 24. This cavity is loaded with gun powder 28. The geometry of the case 12 is chosen to conform with industry standards for a given caliber cartridge, e.g., .223 caliber (equivalent to 5.56 mm, which is designed to be fired from M-16 or M-4 weapons having a closed gas operated system for operation of the bolt of the weapon, for example.) The overall length (QAL) 34 of the cartridge is measured from end-to-end of the cartridge, including the projectile 24. This QAL of a round of ammunition is critical to the successful feeding of the cartridge from a magazine into the firing chamber of a semi-automatic or automatic weapon. As depicted in FIG. 1, the open end 16 of the case receives a projectile 24 which is provided with a rounded leading end 62. FIG. 12 depicts a weapon 100 having a closed gas operated system for operating the bolt 104 of the weapon.

Figure 2:
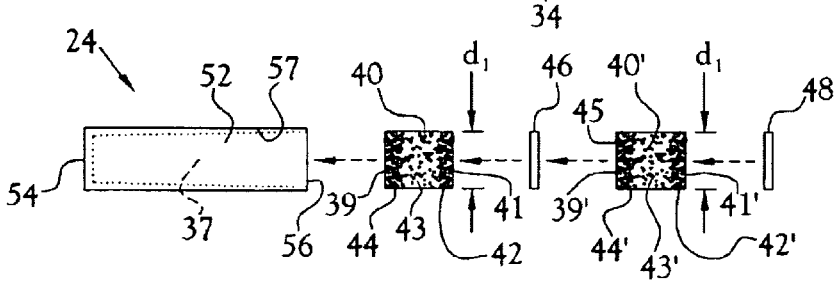
FIG. 2 is an exploded view of the components of one embodiment of a multi-part core comprising two pressed compacts and as employed in the projectile of the present invention.

FIG. 2 depicts an exploded view of a projectile prior to assembly and depicts a cup-shaped jacket 52 having a closed end 54, an open end 56 and a wall 57 defining an internal volume 37 of the jacket. The depicted projectile includes a first compact 40 having a first end 39, a second end 41 and a body portion 43 disposed between the ends 39, 41. Each compact further exhibits more densely pressed end portions 42 and 44. As depicted in FIG. 2, a second compact 40' is substantially identical to the first compact 40. Each compact includes a longitudinal centerline 45. further, in the embodiment depicted in FIG. 2, the projectile includes a first separator disc 46 which is disposed between the abutting second end 41 of the first compact 40 and the first end 39' of the second compact 40'. Each of the compacts is depicted as having the same outer diameter, d1. Still further, the depicted projectile includes a further separator disc 48, which may be substantially identical to the first disc 46 and which is disposed in overlying and abutting relationship to the second end 41' of the second compact 40' and between this end of the compact 41' and the open end 56 of the jacket.

Figure 6:
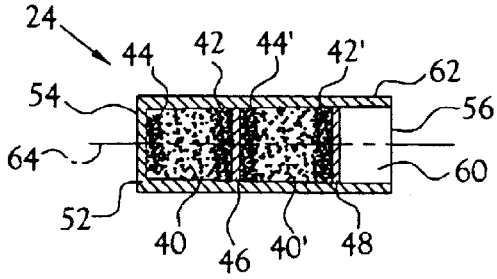
FIG. 6 is a side elevation view, in section, of the projectile components depicted in FIG. 2 as partially assembled into a projectile.
Figure 7:
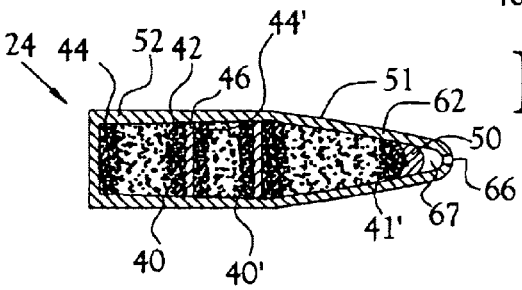
FIG. 7 is a side elevation view, in section, of the projectile components depicted in FIG. 2 as fully assembled into a projectile having an ogive.

FIG. 6 depicts the projectile of FIG. 2 after assembly of the compacts and discs within the jacket and further shows a portion 60 of the jacket which is defined by a portion 62 of the jacket wall and which is void of either compacts or discs. Referring to FIG. 7, the portion 62 of the jacket 52 is depicted as having been infolded toward the longitudinal centerline 64 of the projectile and depicts the deformation of the second end 41" of a three-part core and the most forward disc 50 into an ogive 51. As depicted in FIG. 7, the outboard end of the ogive is incompletely closed, leaving a small opening 66 leading from the exterior of the projectile into a meplat cavity 67 internally of the jacket 52.

It is to be recognized that in a given weapon having a rifled barrel, a projectile 24 fired from the weapon will be spinning about its longitudinal centerline 64 at a rate which is a function of the twist of the lands inside the rifled bore of the weapon barrel. By way of example, M-16 or M-4 military rifle barrels employ a one-in-seven twist, meaning that each land completes a full turn within each seven inches of barrel length. Thus, a projectile fired from these weapons at a velocity of 1050 fps will be spinning about its longitudinal centerline (spin axis) at a rate of 108,000 rpm. For any projectile fired from a rifled barrel, any deviation of the uniformity of density of the projectile radially of its spin axis may result in the projectile spinning out of control along its flight to a target. In similar manner, deviation of the center of gravity of the projectile from a proper location along the length of the longitudinal centerline of the projectile may shift the balance of the projectile by an amount which causes instability of the projectile during its flight to a target. That is, the projectile may tumble or tend to tumble during its free flight or the projectile may exhibit yaw as it flies to a target. Either of these conditions may result in inaccuracy of delivery of the projectile to its target, cause the projectile to generate a sound during its flight to a target, and/or other undesirable characteristics or terminal ballistics. The present inventor has found that near absolute uniformity of distribution of the density of the projectile in a direction radially of the longitudinal centerline of the projectile may be obtained employing the multi-part core of the present invention. Moreover, adjustment of the center of gravity of the projectile, especially a longer projectile, along the length of the longitudinal centerline of the projectile is readily attainable employing the concepts of the present invention. Still further, where it is desirable that a projectile exhibit maximum density for a given length of projectile, the present invention provides for attainment of such maximum density without extra ordinary heat or pressure treatment of the powder mixture from which the projectile is employed. More specifically, it has been noted that when cold pressing a mixture of metal powders in which the predominate metal powder is a heavy metal powder, one can not practically press the powder mixture in a die cavity having an internal cavity length which is greater than about one and one-half times the internal diameter of the die cavity. For example, it is impractical to fill a die cavity having an internal diameter of 0.224 inch with more than about 0.772 inch depth of the powder mixture and expect to cold press the powder mixture beyond a certain density for the reason that beyond such certain density, the powder mixture bridges across the internal diameter of the die to the extent that applying further pressure against the die punch will either deform or break the punch. Or, if the punch survives, the pressed compact can not be removed from the die without destroying the compact. The present invention overcomes this physical limitation by pressing individual compacts of relatively short length to relatively high densities and then combining the high density compacts into a projectile of the desired length and weight. Importantly, the present invention provides also for development and retention of substantially uniform distribution of the density of each compact, hence of the overall projectile, in a direction radially of the longitudinal centerline of the projectile, taken within a plane normal to the longitudinal centerline of the projectile, thereby ensuring spin stability of the projectile. This spin stability is attained irrespective of whether the compacts are pressed to high densities or to lower densities. Through selection of the pressed density of each of the compacts which go to make up a projectile, the density of the projectile itself may be varied in a direction along its longitudinal centerline. This capability ensures the ability to adjust the center of gravity of the projectile to an optimum position along the length of the longitudinal centerline of the projectile.

Each of the projectiles of the present invention comprises a plurality of pressed compacts 40. Each compact is formed from a mixture of metal powders. In accordance with the method of the present invention, the chosen metal powders are mixed and individual quantities of the mixture are pressed at room temperature in a die cavity. The pressure employed is a minimum of that pressure which will produce a pressed compact which can be removed from the die without destruction of the compact and which is self-supporting when outside the die cavity. The maximum pressure employed is that pressure which will not result in binding of the compact within the die cavity to the extent that the compact is destroyed in the course of its removal from the die cavity. Pressures intermediate these minimum and maximum pressures are employed in the production of compacts from specific mixtures of powder metals and/or to obtain some characteristic of a projectile made up of the compacts. Importantly, the pressed compact is not treated with heat and/or pressure between the time that the compact is removed from the die and the time when the compact is placed into a jacket. Any such heat, pressure and/or liquid treatment tends to destroy those properties of the compact which contribute to the overall performance characteristics of the projectile into which the compacts are incorporated.

Also notably, the compacts of the present invention may contain lead as one of the metal powders. In certain of the projectiles of the present invention, it is not intended that lead be supplanted by reason of its environmental impact. Rather, lead is chosen as the "standard" against which the choice of metal powders is made so that users of existing weapons will have a standard against which the firing of the projectiles of the present invention may be compared. That is, so long as the projectiles of the present invention exceed the density of lead, there is minimal necessity for retraining users of a given weapon. In most instances, the projectiles of the present invention outperform lead projectiles for a given weapon so that the user merely enjoys better shooting conditions. Each of the compacts of the present invention includes open interstitial spaces between individual ones of the powder particles of the compact so that the density of the compact is less than the theoretical density of the combination of metal powders which comprise the compact. In all instances, however, it is preferred that the density of the compact equal or exceed the density of lead for the same reasons noted above and to permit the achievement of maximum overall projectile weight in certain projectiles, such as those projectiles which are employed in subsonic ammunition.

In the present invention, each of the compacts preferably is of a straight cylindrical geometry including a first end 39, an opposite second end 41, a cylindrical body portion 43 disposed intermediate the opposite ends, and a longitudinal centerline 45. Preferably each end of the compact is flat and occupies a plane which is normal to the longitudinal centerline 64 of the compact. By pressing the compacts in a cylindrical geometry, the present inventor has found that the distribution of density of the compact may be maintained uniform in a direction radially of the longitudinal centerline of the compact and within any given plane normal to the longitudinal centerline of the compact. This uniformity of density distribution is critical to maximization of the spin stability of a projectile formed from the compacts, and to the establishment of the center of gravity of a projectile along the length of, and coincident with, its longitudinal centerline. The present inventor has found that when die pressing compacts in accordance with the present invention, each of the compacts exhibits a greater density in the regions 47,49 adjacent their respective opposite flat ends. This feature has been employed by the present inventor as a means for increasing the maximum density obtainable for a compact, especially a compact which is at or near a length which is the maximum permissible length for pressing of that particular compact.

It is of further importance in the present invention that the "porous" projectile not be formed with any liquid lubricant, such as a stearate die lubricant. Neither may the compacts be treated with any liquid wash or the like which could leave liquid residue within the compact. Such contaminants adversely affect the uniformity of density distribution of the projectile and may adversely react with the powders of the compact to produce long-term expansion of the projectile during storage or under extreme ranges of temperature during use of a projectile formed from the compacts. In one embodiment of the present invention, there is mixed with the metal powders a dry non-metal matrix powder having the capability of limiting the interparticle bonding between individual ones of the metal powder particles. In this embodiment, the matrix powder is retained within the compact and carried forward into the projectile where the effect of the separation of the metal powder particles is manifested in the frangibility of the projectile when it strikes a target. One suitable matrix powder is a finely divided oxidized homopolymer of polyethylene, such as Acumist 12 from Allied Signal Advanced Materials of Morristown, N.J. This non-metal powder has an average particle size of about 12 microns, with a major portion of the particles being 325 mesh and a density of 0.99 gm/cc. Not more than about 1.2%, by weight, of this powder is acceptable in the compacts of the present invention in that greater amounts of this powder precludes the formation of self-supporting compacts by die forming. Preferably, 0.01% of this matrix powder is employed. In those powder mixtures which include a matrix powder, there is also a beneficial lessening of stratification of the different metal powders of the mixture, hence more uniformity of mixing of the powders which are loaded into a die cavity.

The preferred compacts of the present invention employ tungsten metal powder as the heavy metal powder. In a preferred tungsten metal powder, a major potion of the powder particles thereof being of a size of between about 325 mesh and 400 mesh. One suitable tungsten metal powder is that supplied by Osram Sylvania Products, Inc. of Towanda, Pa. and identified as M-70. Other heavy metal powders, such as tantalum, or their carbides, such as tungsten carbide, for example, may be employed as will be recognized by one skilled in the art.

Among other reasons, in order to adjust the density (weight) of a given compact, the powder mixture employed by the present inventor includes a light metal powder which has a density not greater than the density of lead. This light metal powder may be lead, zinc, tin, bismuth, antimony, aluminum, magnesium or a combination thereof, for example. The proportion of light metal powder to heavy metal powder is selected to ensure that the projectile formed from multiple ones of the compacts is not less than the density of lead. Thus, when employing zinc or tin as the light metal, the percentage, by weight of tungsten, will be at least about 60%. When employing lead, the weight of tungsten can be as low as about 1%, but as a practical matter, the present inventor prefers that the weight percentage of the lead powder in a mixture of tungsten and lead powders be at least about 50% lead powder. A preferred light metal powder is tin powder having a major portion thereof of a particle size between about 325 mesh. One suitable tin powder is identified as Grade 5754 TIN from Acupowder International, LLC of Union, N.J.

Formation of the compacts of the present invention may be performed employing any of several available die pressing devices, including presses which are operated manually, mechanically or hydraulically. Preferably, the dies of the press are formed of an abrasive resistant material such as a metal carbide.

Figure 4:
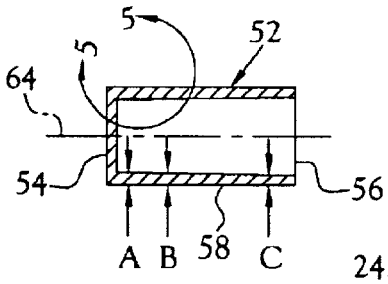
FIG. 4 is a side elevation view, in section, of one embodiment of a jacket employed in a projectile of the present invention.
Figure 5:
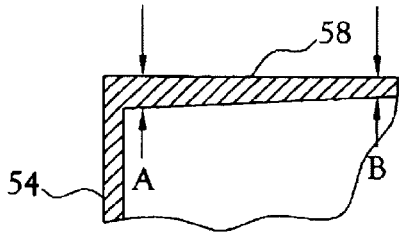
FIG. 5 is an enlarged view of a portion of the jacket depicted in FIG. 4, and taken generally along the line 5—5 of FIG. 4.

In accordance with the present invention, in the formation of a projectile employing cold-pressed compacts 40 of a mixture of metal powders, the compacts are loaded in stacked relationship to one another within a metal jacket 52. Among other things, this jacket provides lubricity between the projectile and the lands of a rifled barrel of a weapon. A preferred jacket is a cup-shaped receptacle of copper or an alloy of copper. Depending upon the method employed in the formation of the jacket, the jacket may exhibit different side wall configurations. As depicted in FIGS. 4 and 5, in one embodiment the jacket may exhibit a side wall configuration in which the thickness of the wall in the region adjacent the closed trailing end 54 of the jacket is of a first thickness, "A", and of a second wall thickness, "B", in the region of the wall intermediate the trailing and leading (open) ends of the jacket, and a third wall thickness, "C", adjacent the open end of the jacket. Thus, this jacket exhibits a substantially cylindrical internal volume 37 which varies from a first internal diameter, through a second and slightly larger internal diameter, and through a third, and slightly still larger internal diameter. It is a major concern in the projectiles of the present invention that the jacket be uniformly and as nearly completely filled as possible to avoid the existence of irregularly located void(s) within the jacket of the completed projectile. Such voids may effectively destroy the desired uniformity of the overall density distribution of the completed projectile and thereby effectively destroy those performance characteristics of the projectile which are being sought.

A further type of jacket comprises a wall thickness which is uniform from end to end of the jacket. The present invention requires that the multiple compacts for a given jacket be formed of appropriate outer diameters which will permit the compacts, which at times may exhibit crushing strengths of only about 200 psi, to be safely inserted into the jackets without deleterious damage to the compact or the dislodgement of powder particles, especially tungsten powder from the compact before it can be pressed into and anchored within the jacket in anticipation of further forming operations of the projectile. When employing the jacket depicted in FIGS. 4 and 5, in accordance with one aspect of the present invention, each of the compacts of a projectile is formed with an outer diameter which is less than the minimum internal diameter "A" of the jacket into which the compact is introduced. In those jackets, such as the jacket 24 depicted in FIGS. 4 and 5, the minimum internal diameter "A" of the jacket occurs in the region thereof adjacent the closed end of the jacket. Compacts intended for introduction into a jacket of this geometry are each formed with a maximum outer diameter which is less than the minimum internal diameter "A" of the jacket. In this manner, any one of the compacts to be placed in the jacket may be the first one inserted into the jacket and therefore be fitted into the jacket adjacent the closed end of the jacket. This feature is of importance from a production standpoint where all the compacts may be of the same outer diameter and thus are indistinguishable from one another, so that production personnel will not mistakenly position a compact within the wrong portion of the jacket.

A principal reason for forming each compact of an outer diameter which is less than the internal diameter of the jacket, is to prevent the dislodgement of powder particles, especially tungsten powder particles from a compact in the course of it being introduced into a jacket. Such loose powder particles tend to escape into that portion of the die which contains and supports the die punch which is used to press the compacts into the jacket and destructively abrade the die and/or the punch. In a typical operation, each compact is formed with an outer diameter which is between about 0.002 inch and about 0.009 inch less than the minimum internal diameter of the jacket, preferably about 0.007 inch less. It will be recognized that such lesser outer diameters of the compacts than the internal diameter of the jacket results in the existence of an annular void space surrounding each compact when it is initially introduced into the jacket. This annular void space is filled by the compact by reason of the pressure axially applied thereto by the die punch. Thus, the pressure applied to each compact is chose to be that pressure which is sufficient to cause the powder particles of the compact to flow radially of the compact and fill the annular void which surrounds the compact. The pressure further functions to ensure complete engagement, without voids, of the abutting ends of adjacent compacts. In this process of axially pressing each compact, the compact necessarily is shortened by a small amount, ie., less than about 0.003 inch, this shortening of the compact being taken into account when initially forming the compact, so that the final volume of the jacket which is occupied by the multiple compacts is that volume which is desired for a given projectile.

Figure 10:
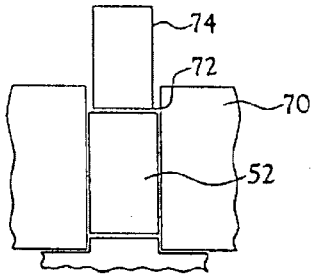
FIG. 10 depicts a weapon 100 having a closed gas operated system 102 for operating the bolt 104 of the weapon.
Figure 9:
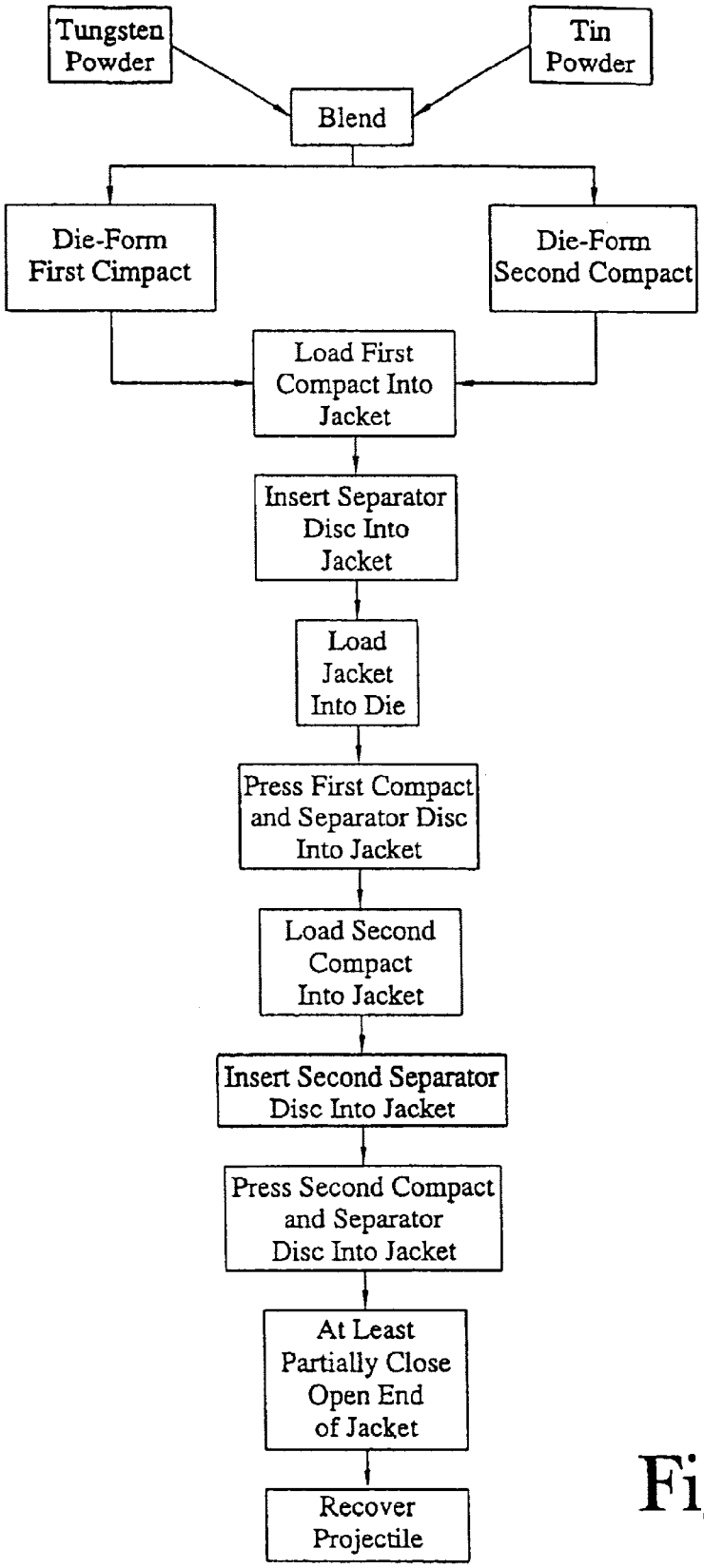
FIG. 9 is a flow chart diagrammatically depicting one embodiment of the method of the present invention.
Figure 11:
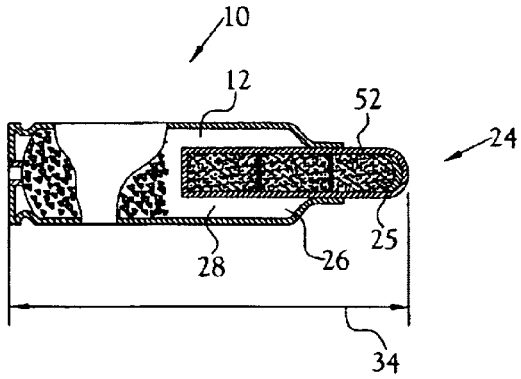
FIG. 11 is a schematic representation of an ammunition cartridge including a projectile of the present invention disposed therein.

In the formation of the projectile, the jacket is disposed with a die 70 (see FIG. 10) having a cavity 72 which substantially conforms to the outer profile of the jacket 52. Thereupon, the first compact is introduced into the jacket and pressed into conformity with the internal volume of the jacket adjacent its trailing end as by a die punch 74. The pressure employed in pressing the first compact is sufficient to ensure that the first end of the compact abuts the closed end of the jacket and to further ensure that the powder particles of the compact flow to the extent that the portion of the jacket volume adjacent the closed end of the jacket is filled by the compact. Thereafter, the second compact is introduced into the jacket with its first end in abutting relationship to the second end of the first compact. This second compact is pressed, using the die punch, into substantially full abutting engagement with the second end of the first compact. Again, the pressure employed is sufficient to ensure that the second compact also fills its adjacent portion of the jacket volume. In certain instances, the pressing of each compact into the jacket may involve compression of each compact in a direction parallel to the longitudinal centerline of the compact. This compression, which does not materially alter the density distribution of the powders within the compact, serves to ensure the elimination of void space(s) between the compact and the internal wall of the jacket, as well as to anchor the compact within the jacket. The present inventor has found that it is preferred that each compact be individually pressed into the jacket if one is to obtain the desired uniformity of density distribution of the resulting projectile. For example, if one loads all of the compacts into the jacket and then attempts to press the compacts axially thereof, the compacts may move unevenly or uniformly within the jacket such that the abutting ends of respective ones of the compacts assume a position within a plane which abnormal to the longitudinal centerline of the projectile and/or the compacts may bind themselves against the internal wall of the jacket and become immovable by the die punch. Recalling that the opposite ends of each compact are more dense than the body portion thereof, the effect of a planar alignment of the abutting ends of adjacent ones of the compacts within the jacket which is not normal to the longitudinal centerline of the jacket exacerbates nonuniform distribution of the density of the projectile.

Figure 8:
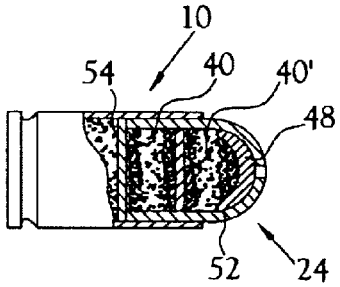
FIG. 8 is a representation of a cartridge, partly in section, depicting various of the features of the present invention.

After the several compacts have been pressed into their respective positions within the jacket, the open end of the jacket is closed. This operation may take the form of infolding of that portion of the jacket adjacent its open end which is not filled with the compacts contained therein, as by die forming either a rounded nose or an ogive at the leading end of the projectile produced. FIGS. 1 and 8 depict a projectile having a rounded leading end 62 and FIG. 7 depicts a projectile having an ogive 51 and at their respective leading ends. In the depicted embodiments, the open end of the jacket is not fully closed. Rather, there is left a small opening 66 which communicates from the exterior of the jacket into a meplat cavity 67 within the jacket. This opening and the meplat cavity are useful in enhancing the separation of the jacket from its contained compacts upon the projectile striking a target. As desired, the extent of closure of the open end of the jacket may be selected by choice of the geometry of the die cavity employed in the die forming of the open end of the jacket.

In another aspect of the present invention, the inventor provides a separator disc at a selected location or locations within the jacket. The preferred separator disc 46 is of a relatively soft, ie., deformable, metal such as tin. Most commonly, the separator disc having planar opposite faces and is of uniform density, of a thickness of between about 0.010 inch and about 0.050 inch, and has an outer diameter which is substantially equal to the inner diameter of the jacket at the location of the disc within the jacket. In one embodiment, a disc 48 or 50 is disposed in overlying and abutting relationship to the second, most outboard, end of the last compact to be introduced into the jacket. This places the disc between the compact and the open end of the jacket.

As depicted in FIGS. 7 and 8, the process of closing of the open end of the jacket by infolding of the jacket wall adjacent its open end, deforms the separator disc 48 and the second end of the second compact, the second end of the second compact being diametrically reduced and squeezed toward the open end of the jacket. This action deforms the separator disc into a generally cup geometry which separates the second compact from the meplat cavity and prevents loose powder particles from escaping into the mepat cavity. Moreover, the separator disc, in its cup geometry, has been found effective in some instances as a penetrator element when the projectile strikes a target.

Figure 3:
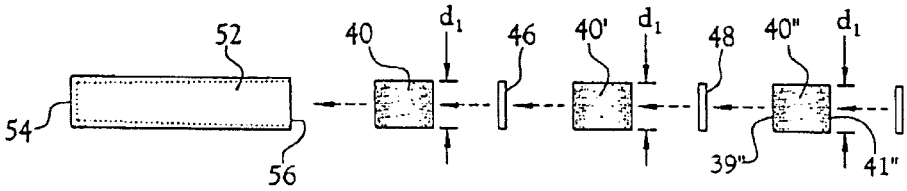
FIG. 3 is an exploded view of the components of one embodiment of a multi-part core comprising three pressed compacts and as employed in the projectile of the present invention.

Unexpectedly, it has been discovered that the presence of separator discs between the abutting faces of adjacent ones of the compacts within the projectile function to develop a train of multiple patterns of disintegration of the powder particles of the several compacts of a projectile when the projectile strikes a target. More specifically, it appears that the presence of the separator discs between the compacts causes a brief delay between the disintegration of third compact and the disintegration of the second compact, and a like brief delay between the disintegration of the second compact and the disintegration of the first compact. In another embodiment, the inventor positions a separator disc between the abutting ends of adjacent ones of the compacts within the jacket. FIG. 2 depicts the placement of a separator disc 46 between the second end of the first compact and the first end of the second compact and a further separator disc 48 between the second end of the second compact and the open end of the jacket. In FIG. 3 there is depicted the placement of a separator disc between the abutting ends of the first and second compacts and between the abutting ends of the second and third compacts, as well as between the second end of the third compact and the open end of the jacket. In the formation of a projectile, each disc is introduced into the jacket as each compact is introduced into the jacket. That is, after the first compact has been introduced into the jacket, and before pressing of the first compact into the jacket, a separator disc is introduced into the jacket in overlying and abutting relationship to the second end of the first compact. Thereafter, the disc and the compact are pressed together into conformity with the internal volume of the jacket. It has been found that this disc enhances the uniformity of distribution of the pressure applied by the die punch over the overall volume of the disc thereby enhancing the assurance that the pressure applied axially to the disc and compact by the die punch is distributed laterally to the circumferential margins of the disc and the first compact theregy enhancing uniformity of pressure across the planar face of the disc and its underlying compact. It has been further found that the pressure applied to the disc and the compact functions to anchor the disc within the jacket and thereby preclude expansion or escape of the compact, or any loose powder particles therefrom, from the jacket in the course of further operations relating to the formation of the projectile. Whereas a single separator disc functions quite satisfactorily between adjacent ones of the compacts of a projectile, it is to be recognized that multiple separator discs may be employed between adjacent projectiles, if desired.

Projectiles produced in accordance with the method of the present invention were produced and fired from various weapons. Table I gives the specifications for typical projectiles produced employing the present method:

TABLE I

| Projectile Weight (gr) | Jacket Length (in) | No. Compacts | Compact Weight (gr) | Compact Length (in) | Compact Diameter (in) | Die Pressure (psi) | Powder Mixture* (**) | Projectile Caliber |
|---|---|---|---|---|---|---|---|---|
| 62 | .67 | 2 | 23.6 | .292 | .190 | 17,000 | W-70 Sn-30 | 5.56 mm |
| 76 | .8 | 2 | 29.5 | .358 | .190 | 25,000 | W-70 Sn-30 | 5.56 mm |
| 87 | .93 | 2 | 32.8 | .339 | .190 | | W-83 Sn-17 | 5.56 mm |
| 103 | .93 | 2 | 41.2 | .341 | .190 | 243,000 | W-97 Sn-3 | 5.56 mm |
| 150 | 1.16 | 3 | 42.3 | .344 | .190 | 300,000 | W-97 Sn-3 | 5.56 mm |
| 253 | 1.4 | 2 | 99.5 | .527 | .257 | | W-80 Pb-20 | .308 |
| 253 | 1.4 | 2 | 99.5 | .527 | .257 | | W-80 Sn-20 | .308 |
| 280 | 1.4 | 3 | 75.4 | .351 | .257 | | W-97 Sn-3 | .308 |

*All compacts included 0.1%, by weight of a non-metal matrix powder
**% by weight The following examples are exemplary of the performance of various projectiles produced in accordance with the present invention. All of the projectiles of the present invention are frangible, that is, the projectile disintegrates into powder particulates upon the projectile striking a solid target such as wood, bone, metal. Further, most of the projectiles disintegrate within a standard 17 inch long gel block. Also, all of the projectiles in the following examples included a 0.030 inch thick tin separator disc between the most second end of the most outboard one of the compacts and the open end of the projectile. Each of the projectiles in the following examples was produced employing the method of the present invention. Further specifications of the core elements (compacts) and other parameters relating to these projectiles are given in Table I.

EXAMPLE I

Sixty-two grain projectiles having a 12 ogive leading end, were fabricated from two compacts plus a separator disc in the leading end thereof. The compacts and disc were pressed into a jacket of 0.72 inch length. Each compact was formed from a mixture of 70%, by weight, tungsten powder and 30%, by weight, tin powder. Typical lengths and diameters of these compacts are given in Table I. Each compact was pressed in a die cavity into a cylindrical compact employing an axially applied pressure of about 20,000 psi. The projectiles were incorporated into rounds of 5.56 mm ammunition employing standard cases containing 21.2 grains of Vihta-Vuori 550 gun powder. These rounds were fired from a standard M-16 military rifle having a 14.5 inch long barrel that included 7 twist rifling. The projectiles exited the muzzle of the weapon at a velocity of between about 1900 and 2000 fps. In one test, these projectiles were fired against the metal walls of a "live fire house" of the type employed in military and police training. All of the projectiles fully disintegrated into powder particulates upon striking a metal wall. No ricochets occurred, even when the projectiles struck a wall at an angle of 10 degrees. To the knowledge of the inventor, this is the only projectile in existence which will perform in this manner. At 200 yards, the projectile exhibited 2.5 minutes of angle (MOA) or less, and at 100 yards the projectile impacted the target at the same point of impact as a standard 5.56 mm M855 projectile (an armor piercing round). When fired into a standard gel block at 25 yards or 100 yards, the projectile created a "wound" cavity of about 10 inches in depth and about 3 to 4 inches in diameter. This round of ammunition can be fired directly against a steel plate from as close as one inch from the target in the fully automatic firing mode of an M-16 rifle without significant danger to the shooter or a bystander. In this firing mode, the round consistently successfully operated the closed gas system for operation of the bolt of the weapon.

EXAMPLE II

Seventy-six grain projectiles produced from 2 compacts and a separator disc disposed in a 0.8 inch long jacket and in substantially the same manner as the projectiles of Example I were incorporated into a standard 5.56 mm case employing 20.0 grains of ViutaVuori 550 gun powder and fired from the same weapons as the sixty-two grain projectiles of Example I and under substantially the same circumstances. The performance and terminal ballistics of these projectiles were substantially the same as those of the sixty-two grain projectiles of Example I.

EXAMPLE III

Projectiles of 87 grains weight were produced in accordance with the present method and employing two compacts and a separator disc. A powder mixture of 83%, by weight of tungsten powder and 17%, by weight of tin powder was pressed in a die to produce the two compacts. Each projectile included an 12 ogive at its leading end and a 7.5 degree boattail at its trailing end. The projectiles were incorporated into standard 5.56 mm cases employing 24.7 grains of VihtaVuori 550 gun powder. These rounds were fired from a standard M-16 military rifle, some firings employing a 26" long barrel, some a 20" long barrel, and some a 14.5 inch long barrel. The projectiles fired from the 26"-barrel had a muzzle velocity of about 2950 fps. Those projectiles fired from the 20" barrel had muzzle velocity of about 2600 fps and those fired from the 14.5" barrel had a muzzle velocity of about 2300 fps. At 600 yards those projectiles fired from the 26" barrel fully penetrated a ⅛" thick cold rolled steel plate. At 600 yards, those projectiles fired from the 20" barrel exhibited a 1.5 MOA in groups of 20 rounds, with groups of 5 rounds in 3–4" groups being common. Projectiles fired from the 20" barrel exhibited less than a 1 MOA at 1000 yards. When fired into a standard 17 inches long gel block, these projectiles commonly produced a wound cavity of about 12 inches in length and about 4–5 inches in diameter. The projectiles fully disintegrated when striking standard military armor plate, without ricochet. These projectiles further exhibited the unusual property of "abrading" a hole through soft steel plate at close ranges when fired at muzzle velocities of between about 1950 and 2000 fps. Unexpectedly, the size of the hole produced by the projectile passing through the steel plate was consistently about 1.5 times the caliber of the projectile. Further, upon exiting the steel plate, the projectile was fully disintegrated and the powder particles thereof lost their velocity with as little as four inches from the exit side of the plate. The present inventor further found that by selectively increasing the muzzle velocity of these projectiles, the dissipation of the powder particles of the projectile could be delayed selectively to greater distances from the exit point from the steel plate, thereby providing the ability of a sniper to fire through a metal wall of a vehicle, for example, and maintain a lethality range of a selected distance by reason of the continuing velocity of the powder particles of the projectile, all without endangering an innocent bystander located within a short distance, e.g., two to three feet, from the intended target. This same result was obtained when firing the projectiles through a windshield of a vehicle, for example.

EXAMPLE IV

Projectiles weighing 103 grains were produced in the same manner as the projectiles of Example III, but with a more dense core. These projectiles were formed from a mixture of 97%, by weight, tungsten metal powder and 3%, by weight of tin metal powder. When fired under the same conditions as the 87 grain projectiles of Example III, the 103 grain projectiles were more accurate in delivery to a target. For example, at 1000 yards, the 103 grain projectiles produced 5-shot groupings of about 6 inches as opposed to the 10" groupings of the 87 grain projectiles.

EXAMPLE V

Employing the present method, projectiles weighing 150 grains were produced from a powder mixture of 97%, by weight of tungsten powder and 3%, by weight of tin powder. In the manufacture of each of these projectiles, three compacts, having an average weight of 42.3 grains each, a length of 0.344 inch, and a diameter of 0.190 inch, were pressed individually into a copper jacket of 1.165 inch length. A 0.030 inch thick tin separator disc was positioned between the second end of the third compact and the open end of the jacket. The end of the jacket was closed by infolding to define a 12 ogive on the leading end of the projectile, leaving an opening of about 0.088 inch in the outboard tip of the leading end of the jacket The ogive was essentially filled by the compact and separator disc. The density of the core formed from the multiple compacts exceeded 17 g/cc. These projectiles were incorporated into a standard cartridge case for an M-16 M-4 military rifle. The case was loaded with 12.74 grains of VihtaVouri 170 gun powder. The overall length of the round of ammunition was 2.250 inches.

These rounds were fired from a standard 5.56 mm M-16 M-4 military rifle having a 14.5 inch barrel and a 7 twist. The muzzle velocity of these projectiles was about 950 fps. At 100 yards, these projectiles produced a grouping of about 3 inches diameter. They fully penetrated a standard 17 inch long gel block at 100 yards. Most importantly, these projectiles were consistently subsonic in flight and consistently functioned perfectly in the rifle when fired in the automatic or semi-automatic mode, including consistent successful operation of the closed gas system for operation of the bolt of the rifle. No other known round of ammunition can achieve these firing specifications. Firing of the same projectiles in the same weapon with a suppresser attached thereto did not alter the functioning of the weapon nor the subsonic nature of the flight of the projectiles to a target.

Whereas these projectiles fully penetrated a 17 inch long standard gel block, they readily disintegrated upon striking a metal surface. Further, contrary to all known projectiles, the projectiles of this Example were found to penetrate a glass object, particularly a laminated glass such as a vehicle windshield, in a straight line and traveled beyond the glass in a straight line to a target and with a lethal energy at the target, due to their extreme hardness and cross-sectional density.

EXAMPLE VI

Projectiles of 253 grains weight for firing in a .300 Winchester Magnum rifle were produced by the present method, employing two compacts and a disc at the leading end of a 1.4 inch jacket. Each compact was formed from a mixture of 80%, by weight, of tungsten powder and 20%, by weight of tin powder. These projectiles were further provided with a 12 ogive and with a 7.5 degree boattail. These projectiles were incorporated into a standard 0.300 Winchester Mag cartridge case employing VihtaVouri 560 gun powder. The projectiles of these round exhibited a muzzle velocity of about 2750 fps. At 1000 yards, the projectiles penetrated a ¼ inch thick cold-rolled steel plate. Also at 1000 yards, these projectiles produced groupings in which the shots were spaced apart about 2.5 inches vertically and about 4.25 inches horizontally. The velocity of these projectiles dropped from the 2750 fps muzzle velocity to 1820 fps. By reason of this exceptionally low reduction in velocity of these projectiles, they were also found to be unexpectedly accurate at 1600 yards. The wind drift factor of these projectiles was noted to be at least 30% less than a solid lead projectile, fired under the same conditions. At 100 yards, these projectiles penetrated a standard 17 inches long gel block a distance of about 15 inches and produced a shock pattern of between about 8 and 9 inches in diameter. The ballistic coefficient of these projectiles was about 700.

EXAMPLE VII

Two hundred eighty grain projectiles of 0.308 caliber were produced employing the present method and three compacts formed from a mixture of 97%, by weight of tungsten powder and 3%, by weight of tin powder, and a separator disc. Three compacts were formed from the powder mixture and introduced into a 1.4 inch long jacket. Each projectile included a 12 ogive and a flat trailing end. These projectiles were incorporated into a standard cartridge case for 0.308 caliber weapons and including VihtaVuori 340 gun powder. These projectiles exhibited a muzzle velocity of about 1000 fps, hence were subsonic in flight. These projectiles exhibited the flattest flight trajectory of any known 30 caliber projectile fired at subsonic velocities. Their ballistic coefficient was about 700. Further, these rounds consistently operated the bolt of the closed gas system for operation of the bolt of the rifle when fired in the semi-automatic or automatic mode. Due to their relatively slow velocity, these projectiles fully penetrated a standard 17 inch long gel block.

From the foregoing examples, it will be recognized that the present method for the manufacture of projectiles for gun ammunition provides the means whereby there may be produced projectiles for a very large range of firing conditions. Given the disclosure of the present invention, one skilled in the art can design projectiles, and rounds of ammunition employing the projectiles, wherein the projectiles exhibit more or less frangibility when they strike a hard target, more or less penetrability of targets, and/or combinations of these terminal ballistics. Importantly, the present method provides also the means for achieving the desired terminal ballistics while also enhancing the accuracy of flight of the projectiles to a target. Moreover, the present method provides the first 5.56 mm or .308 caliber projectiles which may be fired at subsonic velocity from a weapon having a closed gas system for operation of the bolt of the weapon, and consistently produce the gas pressure necessary for operation of the bolt. This feature is achievable only with a projectile having the mass which is made possible by the present method.

In one embodiment of the present method the present inventor provides for the production of the manufacture of a projectile to be employed in a cartridge designed to produce subsonic flight of the projectile to a target from a weapon fired in the semi-automatic or automatic mode and having a closed gas system for operation of the bolt of the weapon. This embodiment of the method includes the steps of introducing into a cartridge case having a closed end and an open end and designed for firing of a projectile from the weapon, a quantity of slow burning gun powder to partially fill said case. In a 5.56 mm cartridge case about 12.4 grains of VihtaVouri 170 gun powder is loaded into the case. Thereafter, there is disposed in the open end of the case, a projectile having an overall weight, e.g. about 150 grains, which is substantially in excess of the overall weight of a comparable sized lead projectile. The projectile closes the open end of the case and extends into said case a distance of at least about one-third of the length of the case, but terminating short of the level of the gun powder present in the case, and with at least a portion of the projectile projecting beyond the closed end of the case. In this embodiment, the combination of weight of the projectile and the quantity of slow burning gun powder is chosen to be sufficient to produce sufficient gas pressure within the closed gas system of the weapon to consistently operate the bolt of the weapon.

Importantly, the overall length of the cartridge of this embodiment of the method permits the feeding of multiple ones of the cartridges, one at a time, from a magazine and into the firing chamber of the weapon so that the weapon can be consistently operated in the semi-automatic or automatic firing mode.

Further in this embodiment of the present method, the projectile is formed from a metal jacket having an open end and an internal volume, and a core comprising a plurality of compacts disposed within the jacket. Each of the compacts is formed from a mixture of a heavy metal powder and a light metal powder, e.g., 97%, by weight of a tungsten powder and 3%, by weight of tin powder, to form a compact which is of generally straight cylindrical geometry having first and second opposite ends and a cylindrical body portion intermediate its opposite ends. The compact so formed is of a density greater than the density of lead and of a length which is less than the full desired length of the core. The combined lengths of the plurality of compacts incompletely fill the jacket when the compacts are stacked one on the other within the jacket and thereby leave a portion of the jacket adjacent the open end thereof void of the compacts. A separator disc is placed in the jacket adjacent its open end. Thereafter, that portion of the jacket which is void of the compacts is infolded toward the centerline of the jacket to at least substantially close the open end of the jacket, such infolding causing at least a portion of that compact adjacent the open end of the jacket and the separator disc to at least partially fill the infolded portion of the jacket. By reason of the combined weight of the projectile that is provided for by forming the core of the projectile from a plurality of individually formed compacts of a mixture of a heavy metal powder and a light metal powder and by forming the projectile of a length which extends abnormally far into the case (at least about 35%, and preferably 42% of the length of the projectile is disposed within the interior of the case), the projectile requires a relatively large gas pressure for it to be propelled through the barrel of the weapon. This increased resistance of the projectile to movement through the barrel of the weapon and the use of a slow burning gun powder, such as VihtaVouri 170 gun powder, provides for the build up within the barrel at the gas port of closed gas system employed to operate the bolt of the weapon, a pressure which is sufficient to consistently operate the bolt of the weapon, and to propel the projectile from the weapon at a subsonic velocity. This cartridge, being capable of being produced with the required weight and also of an overall length which permits it to be fed from a magazine into the firing chamber of the weapon, permits the use of the same weapon for firing of either subsonic or supersonic ammunition, a feat which has long been sought and which, prior to the present invention, has eluded those skilled in the art. For example, heretofore, in a military operation where it was desired that a combatant be prepared to first fire subsonic ammunition and thereafter fire supersonic ammunition, it was necessary for the combatant to carry two weapons, one for firing subsonic ammunition and another for firing supersonic ammunition. This requirement of two weapons also required the combatant to carry two supplies of ammunition, one subsonic and one supersonic, thereby burdening the combatant with undesirable weight to carry into battle, as well as encumbering his movements.

Whereas the present invention has been set forth in specific terms for clarity of disclosure, it is understood that one skilled in the art will recognize equivalents of various of the parameters set forth herein and it is intended that the invention be limited only in accordance with the claims appended hereto.

What is claimed is:

1. A method for the manufacture of a round of ammunition suitable to produce subsonic flight of a projectile to a target from a weapon fired in the semi-automatic or automatic mode and having a closed gas system for operation of the bolt of the weapon comprising the steps of forming a projectile including a metal jacket having a closed end, an open end and an internal volume, and a core comprising a discrete compact disposed within said jacket, said compact being formed from a mixture of a heavy metal powder and a light metal powder to form a self-supporting compact having first and second ends and a generally cylindrical body portion intermediate said ends, said compact having a length which is less than the full length of said jacket and leaving a portion of said jacket adjacent said open end thereof void of said compact, and thereafter infolding said portion of said jacket which is void of said compact to at least substantially close said open end of said jacket, said infolding causing at least a portion of said compact proximate said open end of said jacket to at least partially fill said infolded portion of said jacket, said projectile having a weight in excess of the weight of a lead projectile of comparable size and geometry, introducing into a cartridge case suitable for receipt in the firing chamber of the weapon and having a closed end and an open end which includes a neck portion contiguous thereto and for firing a projectile from the weapon, a quantity of gun powder to partially fill said case, disposing said projectile in said open end of said case, said projectile closing said open end of said case and extending into said case a distance of at least beyond said neck portion of said case, and with at least a portion of said projectile projecting beyond said closed end of said case, whereby said weight of said projectile and said quantity of gun powder cooperatively combine to produce gas pressure within the closed gas system of the weapon to consistently operate the bolt of the weapon and to propel said projectile from the weapon at less than sonic speed when said cartridge is fired in a weapon.

2. The method of claim 1, wherein the combined length of said cartridge case and that portion of said projectile projecting from said open end of said case permits the feeding of multiple ones of the cartridges, one at a time, from a magazine and into the firing chamber of the weapon.

3. The method of claim 1 and prior to infolding of said open end portion of said jacket, including the step of interposing within said jacket a separator in intimate relationship to that end of said compact which is proximate said open end of said jacket.

* * * * *